United States Patent [19]

Crowell

[11] Patent Number: 4,592,573

[45] Date of Patent: Jun. 3, 1986

[54] THREE-DIMENSIONAL POP-UP MESSAGE DISPLAY STATIONERY

[75] Inventor: Christopher S. Crowell, Old Lyme, Conn.

[73] Assignee: Structural Graphics, Inc., Essex, Conn.

[21] Appl. No.: 601,977

[22] Filed: Apr. 19, 1984

[51] Int. Cl.[4] ..... G09F 1/00; G09F 19/00

[52] U.S. Cl. ..... 283/56; 40/124.1

[58] Field of Search ..... 283/56, 903; 40/124.1, 40/124.4, 539; 434/161, 176; 446/147, 148, 149, 150

[56] References Cited

U.S. PATENT DOCUMENTS

| | | | |
|---|---|---|---|
| 2,458,879 | 1/1949 | Schenk | 446/148 |
| 2,609,639 | 9/1952 | Barker | 446/150 |
| 4,146,983 | 4/1979 | Penick | 40/124.1 |

FOREIGN PATENT DOCUMENTS

| | | | |
|---|---|---|---|
| 513339 | 11/1930 | Fed. Rep. of Germany | 446/148 |
| 1373142 | 8/1964 | France | 40/124.1 |

*Primary Examiner*—Paul A. Bell
*Assistant Examiner*—Paul M. Heyrana, Sr.
*Attorney, Agent, or Firm*—Mattern, Ware, Stoltz & Fressola

[57] ABSTRACT

A folded stationery piece has a three-dimensional pop-up message displayed along an internal fold line, formed by an arrayed sequence of letters with the spaces between them removed. The letters and bridge webs joined to their upper edges are both hinged to the stationery panels, forming a collapsible parallelogram structure. The message display can be formed as a separate insert, to be adhesively mounted along a fold line of any piece of stationery by the user.

10 Claims, 17 Drawing Figures

THREE-DIMENSIONAL POP-UP MESSAGE DISPLAY STATIONERY

TECHNICAL FIELD

This invention relates to folded stationery, paper sheets, cards, or the like, incorporating three-dimensional pop-up erectable indicia, such as letters, numbers or pictorial shapes, positioned along an interior fold, which are collapsed flat as the stationery is folded for mailing and storage, and are erected 3-D fashion for upstanding display in front of the normal front faces of the stationery as it is unfolded for examination by the sender or recipient, providing an attention-getting message permanently displayed by the stationery.

BACKGROUND ART

Folded greeting cards, advertising novelties, and pop-up books for many years have incorporated collapsible structures of paper and pasteboard which are drawn from a flat folded configuration to an upstanding, erect configuration by the unfolding of the booklike folder. U.S. Pat. Nos. 2,102,075; 2,742,723; and 3,090,144 are examples of such structures. Complex composite constructions representing trees, foliage, landscapes, buildings, vehicles, animals, and people have been fabricated and sold in such collapsible pop-up form for many years. These are illustrated by U.S. Pat. Nos. 1,841,041; 1,901,661; 2,205,262 (Re. 22,109); and 2,692,530. Arrayed sequences of alphabetical letters spelling a message have occasionally been displayed on sign boards forming a portion of such pop-up constructions, and individual free-standing letters or numbers have been used in many kinds of "three-dimensional" counter displays and advertising signs, such as those shown in U.S. Pat. Nos. 1,901,661; 2,102,075; and 2,132,649.

However, applicant believes that such letters or numbers have never been presented individually arrayed in sequence in any such prior art pop-up folded stationery or greeting card constructions, of the kind exemplifying the present invention.

SUMMARY OF THE INVENTION

A striking impact is created upon the mind of the viewer by individual free-standing letters displayed substantially spaced forward, in front of the normal front surface of a folded greeting card or a folded sheet of stationery. This creates the illusion that the message thus delivered by a missive of the present invention is carved from stone or other blocks of solid material.

As shown in the drawings, the free-standing arrayed sequences of pictorial shapes such as alphabetical letters characterizing the present invention are spaced well forward of a fold in the greeting card or sheet of folded stationery, apparently resting on or growing upward from the lower stationery panel beneath the fold, with narrow webs bridging the space between the upper edges of the arrayed letters and the upper stationery panel above the fold, which is embraced by and hidden behind the message-bearing letter array. A surprising impression of sturdy solidity is thus created in the mind of the viewer. In one embodiment of the invention, the bridging webs themselves are formed in the shape of an arrayed sequence of alphabetical letters providing an additional line of message-bearing indicia.

The letters and bridging webs of the invention may be formed directly by stamping from the foldable stationery blank itself, and in one form of the invention the letters and bridging webs are formed from a separate display panel having adhesive tabs for direct adherence to the foldable stationery sheet along one of its interior folds. Such separate collapsible and erectable message displays make it possible for the user to "build his own" pop-up message display stationery. Indeed, individual letter pop-ups having adhesive tabs for mounting at the interior fold of a sheet of stationery allow the user to mount and display his own custom-made pop-up message, his initials, or any other display desired. Harmonizing or contrasting colors for the letters and the background, the reverse side of the mounting tabs, provide an eye-catching contrast to the color of the stationery sheet, if desired.

Accordingly a principal object of the present invention is to provide a folded advertising or promotional card, direct mail notice, greeting card or stationery sheet displaying upstanding, arrayed sequences of pictorial symbols conveying a message to the viewer, positioned in front of the normal face of the folded card or sheet.

Another object of the invention is to provide such arrayed sequences of symbols or letters formed from the stationery sheet itself by removing therefrom the spaces between the letters and their positioning bridge webs.

Still another object of the invention is to form such collapsible and erectable rows of letters and bridge webs in an array forming with the supporting fold-joined stationery panels a collapsible structure having a parallelogram cross-section, assuring its reliable collapse and erection with every folding and unfolding flexture of the supporting folded stationery sheet about the fold line along which the letters are positioned.

A further object of the invention is to provide such upstanding arrays of letters and support panels as a separate collapsible unit which may be secured by adhesive to any folded sheet of stationery along a fold line thereof.

A still further object of the invention is to provide such separate letter arrays with self-adhesive supporting tabs protected by peelable backing strips for convenient selection and mounting by the user at any desired location along an interior fold of any sheet of stationery.

Another object of the invention is to provide a foldable card or sheet which is conveniently inserted in and typed upon by a typewriter or computer printer and then quickly decorated with a separate pop-up three-dimensional message-bearing insert adhesively secured to the card or sheet along an internal fold line.

Other objects of the invention will in part be obvious and will in part appear hereinafter.

The invention accordingly comprises the features of construction, combinations of elements, and arrangements of parts which will be exemplified in the constructions hereinafter set forth, and the scope of the invention will be indicated in the claims.

For a fuller understanding of the nature and objects of the invention, reference should be had to the following detailed description taken in connection with the accompanying drawings.

BEST MODE FOR CARRYING OUT THE INVENTION

Figure 5:
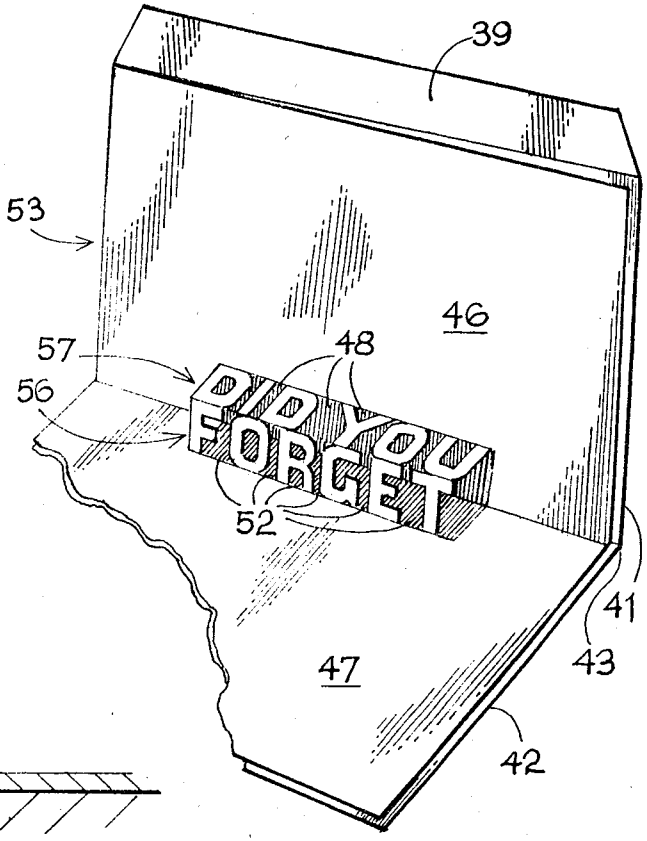
FIG. 5 is a perspective view of a folding stationery sheet with a self-sealing envelope tab, similar to the embodiment shown in FIG. 2, and incorporating a "double-deck" series of arrayed sequences of letters forming a two-line display standing out before the front surfaces of the folded stationery sheet along an interior fold line.

As shown in the drawings, all embodiments of the invention present an arrayed series of symbols, numbers, letters or comparable message-carrying indicia, such as company logos, displayed pop-up fashion along an interior fold of a sheet of stationery, and positioned in front of the stationery sheet by bridge web means, formed as individual separate webs in the case of an arrayed series of alphabetical letters, extending from the upper edge of each letter to the stationery sheet behind the letter. In the embodiment of FIG. 5, the bridge webs themselves are formed in the shape of a separate row of letters producing two arrayed sequences of letters positioned one above the other to form a double-line message.

Figure 2:
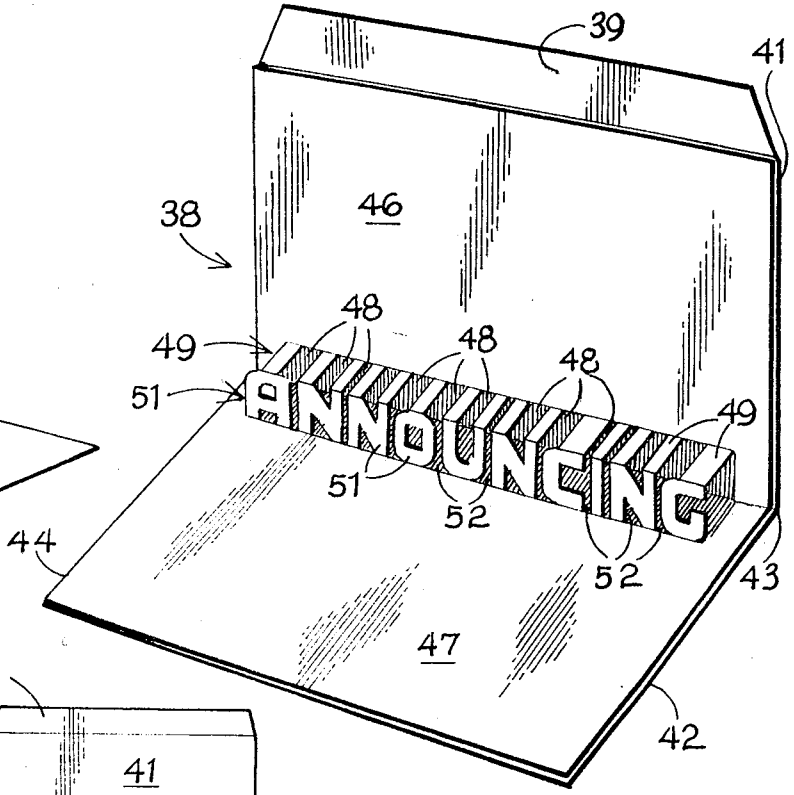
FIG. 2 is a perspective view of a double-folded sheet or stationery with one panel having a protruding tab that can be gummed or adapted to receive a wafer seal for forming a self-sealing envelope, and incorporating an arrayed sequence of letters formed directly from the stationery sheet along a fold line by cutting the spaces therebetween away from the stationery sheet.
Figure 3:
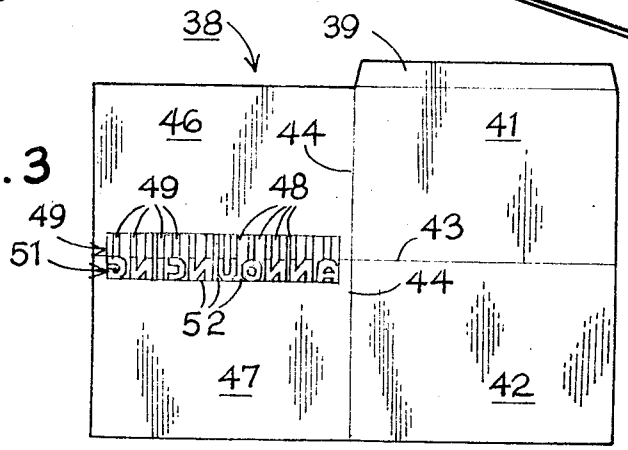
FIG. 3 is a reduced size plan view of the unfolded sheet of FIG. 2 showing die-cut spaces removed therefrom between the letters along a fold line to form the display illustrated in FIG. 2.

In all cases, the decorative message-bearing indicia protrude from the stationery in front of a fold line, being mounted on or comprising a parallelogram support which may be formed from the stationery itself, in the case of the die-cut letters illustrated in FIGS. 2 and 3.

Alternatively, the parallelogram support may be formed as a separate die-cut insert incorporating the pictorial cutouts or letters and their bridge webs combined with a rear mounting panel and a base mounting panel preferably secured by adhesive to the foldable stationery sheet, with the mounting panels flanking an interior fold line of the stationery sheet, thus causing the parallelogram to flex and collapse when the stationery is folded about its fold lines. By using backing strips peelable from self-adhesive coatings on the mounting panels or by pre-glueing with re-moistenable glue, such die-cut inserts can be purchased in quantities by the consumer and individually mounted on any folded piece of stationery desired at any time.

When using an arrayed sequence of letters or numbers as the message-bearing die-cut indicia, letters or numbers all of the same height are preferred, thereby arraying all of the bridge webs in substantially a single plane, as illustrated in FIGS. 7–9 and 11–13. In the case of FIG. 5 where the bridge webs themselves are die cut to form an upper series of letters, producing a two line message, the letters forming each aligned row are most readable if they all fall in the same plane.

Figure 1:
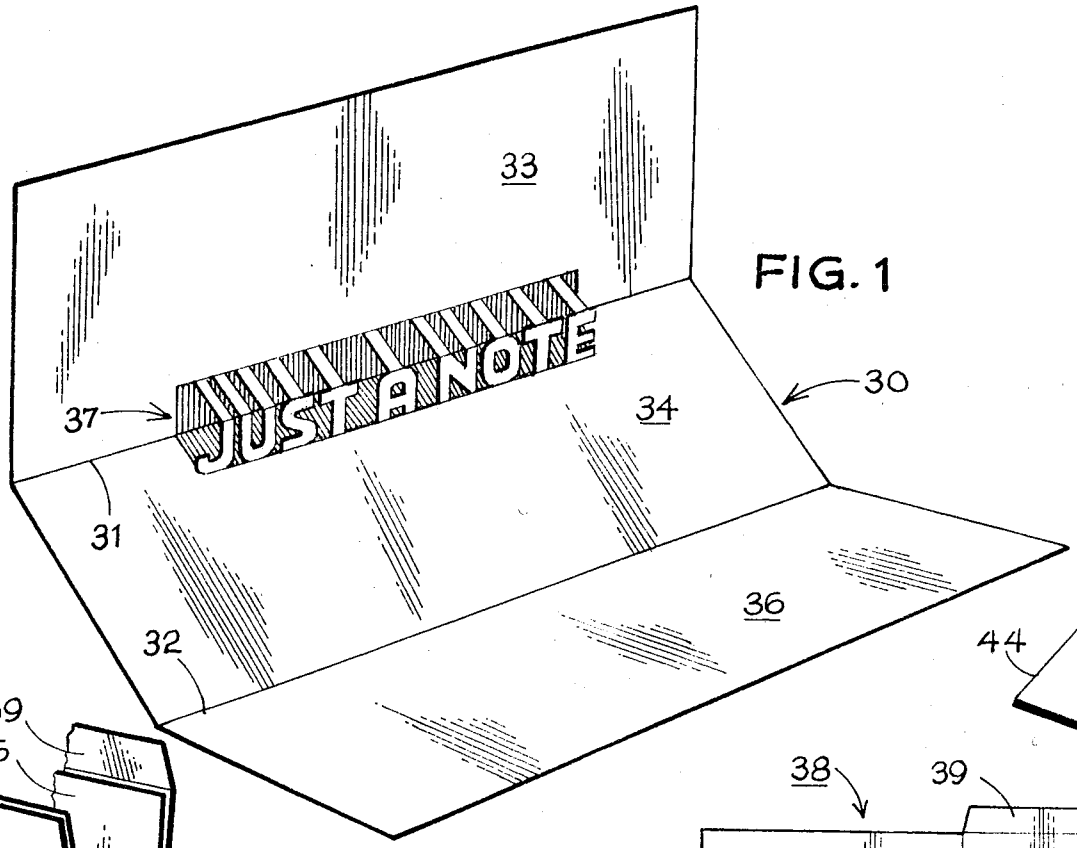
FIG. 1 is a perspective view of a folded stationery sheet incorporating an arrayed sequence of pop-up letters positioned in erectable configuration along each side of an interior fold line.

In the embodiment illustrated in FIG. 1, the stationery sheet 30 is provided with a pair of fold lines 31 and 32 which can be scored or precisely folded by hand or machine dividing the sheet 30 into three panels: an upper panel 33, a center panel 34, and a lower panel 36. Juxtaposed with the mid-portion of the upper transverse fold line 31 is a die-cut insert 37, such as the insert shown in the form of a die-cut blank 58 in FIG. 6 or the similar insert 71 of FIG. 10.

While presenting a comparable appearance, the pop-up stationery 38 in FIG. 2 incorporates a double-folded sheet with a protruding sealing tab 39 to produce a self-sealing envelope formed of the folded stationery itself, and with the inner folded half-sheet having its fold line cut away by a series of die cutouts, leaving in place an arrayed sequence of letters and bridge webs which may all be everted to form the pop-up message display, as shown in FIG. 2. As more clearly shown by the blank of FIG. 3 from which the embodiment of FIG. 2 is folded, the double-folded stationery sheet 38 has four panels or segments: (1) an upper back panel 41 from which gummed tab 39 protrudes upward; (2) a lower back panel 42 joined to upper back 41 by a contiguous fold line 43 forming the lower edge of upper panel 41 and the upper edge of lower panel 42; (3) an upper front panel 46; and (4) a lower front panel 47, contiguously joined along the left edge of panels 41 and 42, which is formed as a fold line 44. The extension of fold line 43 across the blank between upper front panel 46 and lower front panel 47 provides the location for the series of die cutouts 48 between the various strips forming bridge web sheet segments 49 extending from upper front panel 46 to the upper edges of the arrayed sequence of letter sheet segments 51, whose lower edges are foldably joined to the lower front panel 47, the spaces between letters 51 being die cutouts 52.

The similar double-folded sheet 53, shown in FIG. 5, has the same panels 41, 42, 46, and 47 and same sealing tab 39, but it differs from double-folded stationery sheet 38 in having a double row of message-bearing letters forming the die-cut protruding everted sheet segments 56 and 57, positioned along its internal fold between panels 46 and 47. In this embodiment of the invention, upstanding letters 56 forming the lower row of indicia-bearing symbols are separated by die cutouts 52, like letters 51 in FIG. 2. In FIG. 5, however, the bridge webs are formed as the upper row of letters 57 joined at their forward edges along a fold line to the upper edge of the lower row of letters 56, and having rear edges foldably joined to upper front panel 46, as shown in FIG. 5.

The double rows 56 and 57 of message-bearing letters can also be formed as an insert like insert 37 illustrated in FIG. 1.

The separate adhesively coated inserts illustrated in FIGS. 6–13 provide unusually versatile flexibility for the stationery of the present invention, since they may have adhesive surfaces protected by peelable backing strips or registered pre-glueing needing re-moistening, allowing the user to mount them wherever desired.

Figure 6:
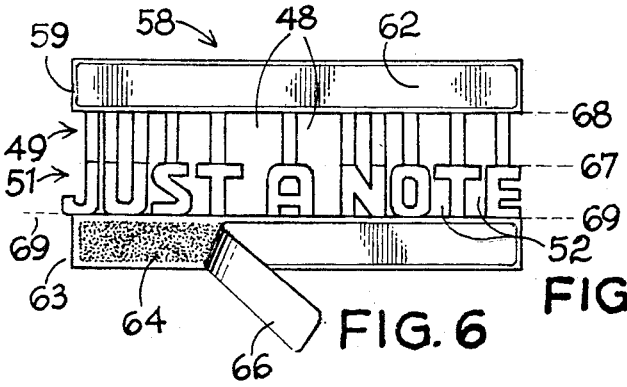
FIG. 6 shows a separate die-cut blank for an insert incorporating an arrayed series of letters with bridging webs extending foldably from their upper edges toward and joined at a fold line to a rear mounting panel, and with their lower edges being joined along a fold line to a base mounting panel.
Figure 7:
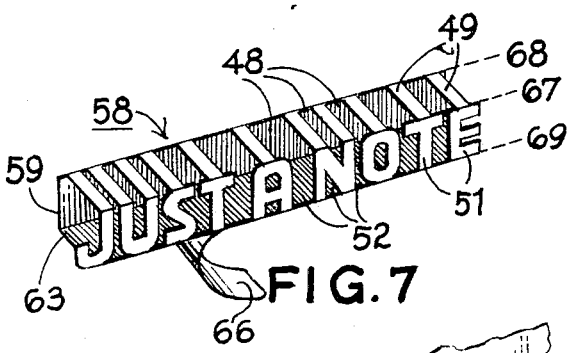
FIG. 7 is a perspective view of the insert of FIG. 6 formed in its erected configuration for mounting on a sheet of stationery.
Figure 8:
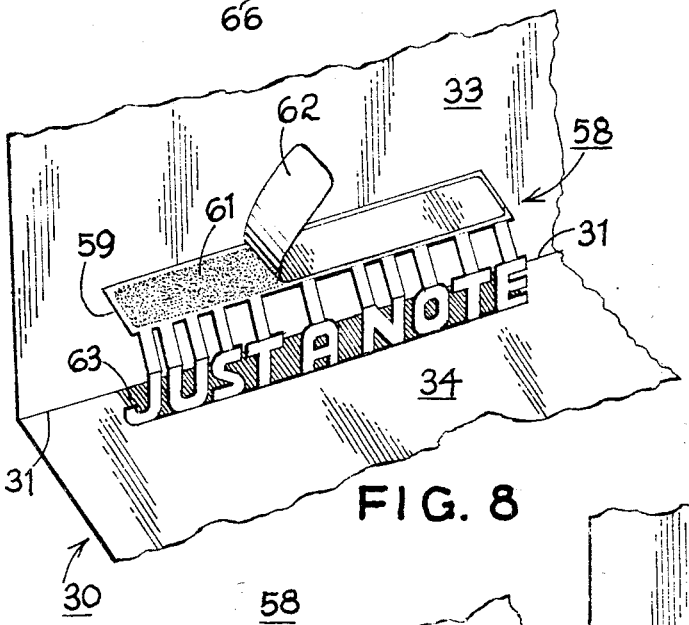
FIG. 8 is a fragmentary perspective view of a stationery sheet showing the insert of FIG. 6 with its self-adhesive base panel mounted on the sheet adjacent to the fold line.

In the embodiment shown in FIG. 6, letters 51 and bridge webs 49 are formed by having their intervening spaces 48 and 52 removed by die cutting them from the insert blank 58, whose uppermost portion is formed as a rear mounting panel 59, having its top face coated with self-adhesive 61, as illustrated in FIG. 8, covered by a peelable backing strip 62, shown being lifted and peeled away in FIG. 8. The lower portion of blank 58 is formed as a base panel 63, likewise coated with a self-adhesive coating 64, which is also covered by a peelable backing strip 66, shown in the process of being peeled away in FIGS. 6 and 7.

The flat blank 58, shown in FIG. 6, is foldable along three fold lines. The central fold line 67 joins the tops of letters 51 to the forward ends of bridge webs 49. The upper fold line 68 joins the rearmost or uppermost ends of bridge webs 49 to the contiguous edge of rear panel 59. The lower fold line 69 provides the hinge line along which the lower edge of the letters 51 are foldably joined to the upper edge of base panel 63.

The die-cut insert blank 58 of FIG. 6 with its mounting panels being coated with moistenable glue or adhesive 61 and 64 is folded along its fold lines 67, 68 and 69 into a parallelogram cross-section shape for mounting on a sheet or stationery, in the configuration shown in FIG. 7, where its parallelogram shape is seen in perspective. In this shape the rear mounting panel 59 and the base mounting panel 63 are brought into close proximity, with their free edges juxtaposed. After this folding along the fold lines 67, 68 and 69, and the removal of the peelable strip 66 from the adhesive coated outer face 64 of base panel 63, as shown in FIG. 7, or re-moistening of adhesive coating 64 if necessary, the insert is moved into position, with the free edge of its base panel 63 closely adjacent to the fold line 31 between upper panel 33 and center panel 34 of the stationery sheet 30, where its self-adhesive face adheres to panel 34, positioning the insert at the desired location beside fold line 31.

The peelable backing strip 62 is then removed from the self-adhesive coating 61 of rear mounting panel 59, as indicated in FIG. 8, or adhesive coating 64 is re-moistened if required. The rear mounting panel 59 is then folded down toward fold line 31 into juxtaposition with base panel 63, as indicated in FIGS. 7 and 9, and its adhesive coating 61 adheres to top panel 33 of stationery sheet 30.

Figure 4:
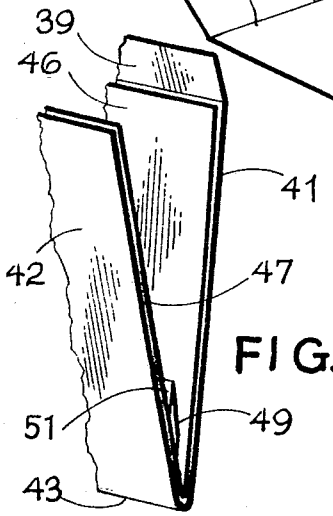
FIG. 4 is a fragmentary perspective view of the embodiment of FIG. 2 in the process of being folded to form a self-sealing envelope showing the arrayed sequence of letters in its collapsing position.
Figure 9:
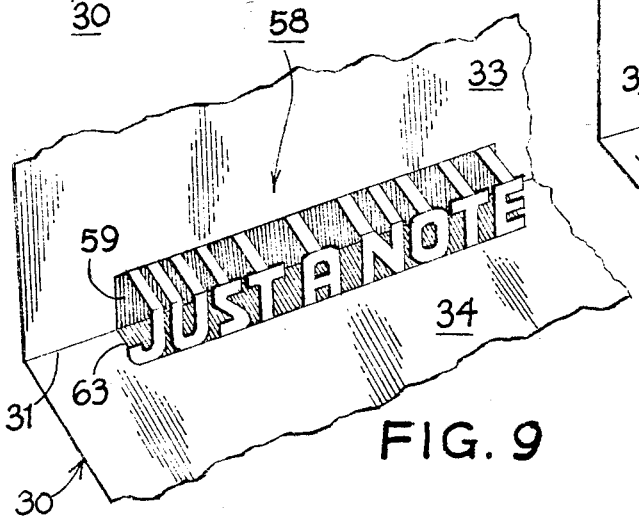
FIG. 9 is a corresponding fragmentary perspective view of the insert of FIG. 6 with its rear mounting panel adhesively secured to the stationery sheet on the opposite side of the fold line from its base panel, forming the completed display structure illustrated in the embodiment of FIG. 1.

Thus, as indicated in FIGS. 1 and 9, the pop-up message-bearing insert is permanently positioned along the fold line 31 and easily collapsed, as indicated in FIG. 4, when the stationery sheet is folded. When the sheet is unfolded, the message is automatically erected and conveniently displayed in a striking, three-dimensional manner. For best positioning of the insert relative to its supporting foldable stationery sheet 30 after base panel 63 has been adhered in place on center panel 34, adjacent to fold line 31, it may be desirable to fold the insert about its central fold line 67, virtually flattening the insert to produce nearly a 180-degree fold at the central fold line 67 while leaving the insert substantially flat at its other fold lines 68 and 69. In this position, the removal of peelable backing strip 62 exposing the self-adhesive coating 61 leaves that self-adhesive face of rear mounting panel 59 exposed in substantially its final position when stationery sheet 30 is folded closed about fold line 31 with panel 33 closely adjacent to panel 34. By folding sheet 30 in this manner and bringing panel 33 down upon self-adhesive coating 61 while the insert remains in this substantially flattened position, the optimum folded positioning of the insert relative to sheet 30 is assured, and the automatic unfolding erection of the insert to the position shown in FIGS. 1 and 9 follows whenever stationery sheet 30 is unfolded about its fold line 31.

Figure 10:
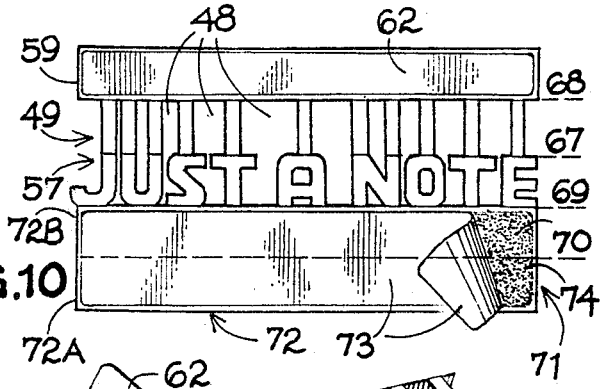
FIG. 10 is a top plan view of a similar separate die-cut blank for an insert having a scored, double-width base panel.

The alternative die-cut insert embodiment 71, shown in FIGS. 10–17 is very similar to the die-cut insert made from blank 58, shown in FIGS. 6–9. Blank 71, however, has a base panel 72 which is substantially double the width of base panel 63 of blank 58, shown in FIG. 6. In addition, the double width base panel 72 is preferably provided with a double width peelable backing strip 73, as shown in FIG. 10.

Figure 14:
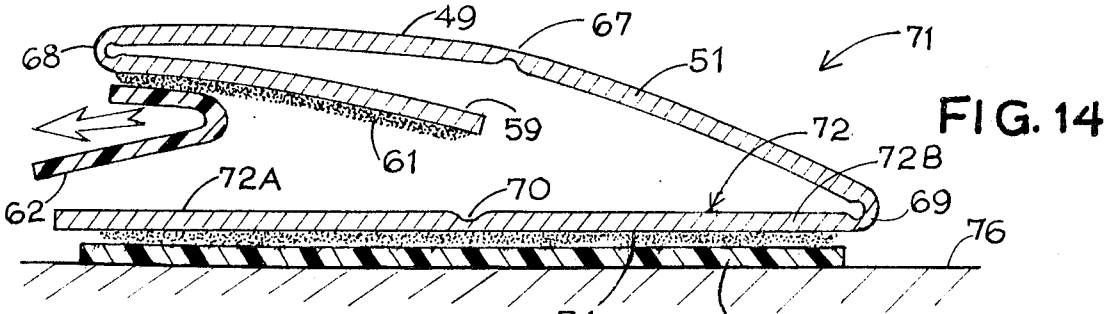
FIGS. 14 through 17 are diagrammatic end elevation views showing the insert of FIG. 10 in various stages of its assembly, insertion, and mounting along the interior fold of a supporting stationery sheet.
Figure 15:
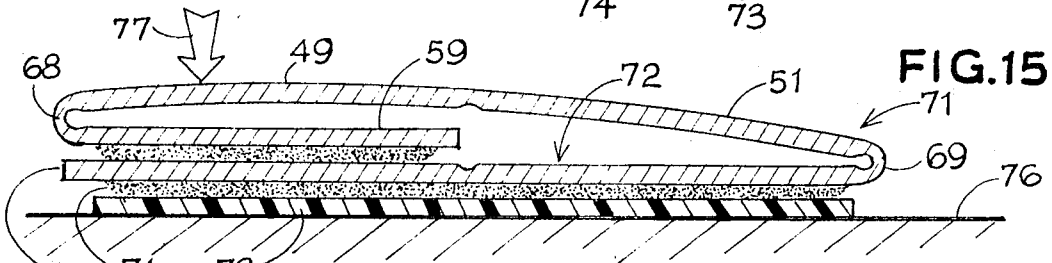
Figure 11:
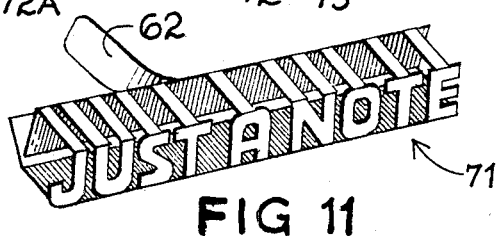
FIG. 11 is a perspective view of the insert of FIG. 10 in the process of being folded for assembly.

One preferred technique for assembling the die-cut insert of 71 of FIG. 10 is illustrated in FIGS. 11–17. As shown in FIGS. 11 and 14, the removal of peelable backing strip 62 from the adhesive 61 on rear mounting panel 59 exposes the adhesive 61 ready for adherence to the reverse side of the distal half 72A of the double-width base panel 72, which is joined to the proximal half 72B of base panel 72 by an extra scored fold line 70. The lower edge of the arrayed sequence of letters 51 is joined by the same fold line 69 to the adjoining edge of proximal segment 72B of the double-width base panel 72, and the upper edge of letters 51 is joined by fold line 67 to bridge webs 49 whose opposite ends are joined by fold line 68 to rear mounting panel 59, all as shown in FIGS. 10 and 14.

Figure 16:
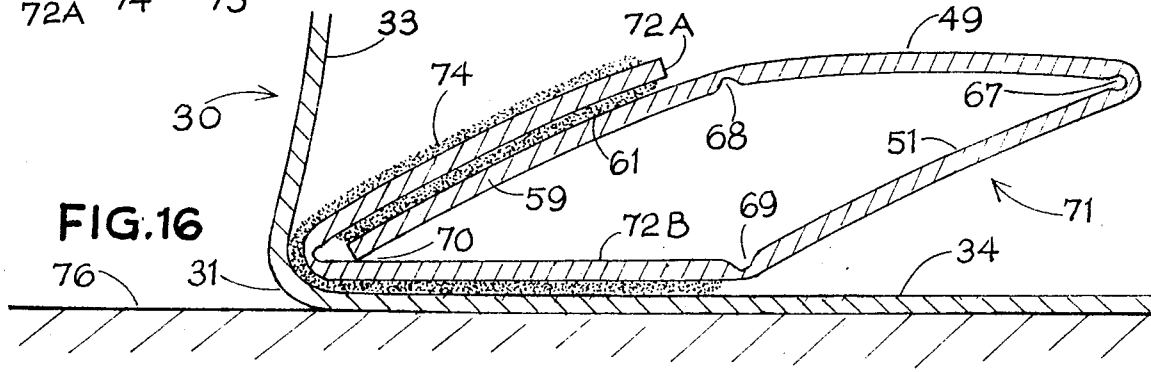
Figure 12:
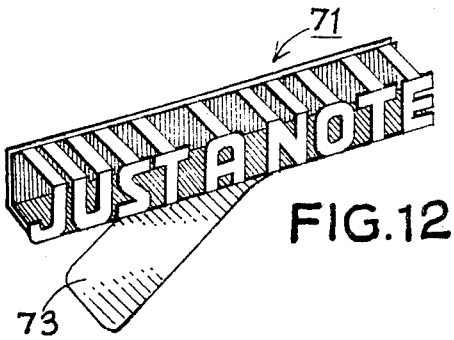
FIG. 12 is a perspective view of the insert of FIG. 10 in its assembled and glued erect condition with a peelable backing strip in the process of being removed from its double-width base panel.
Figure 13:
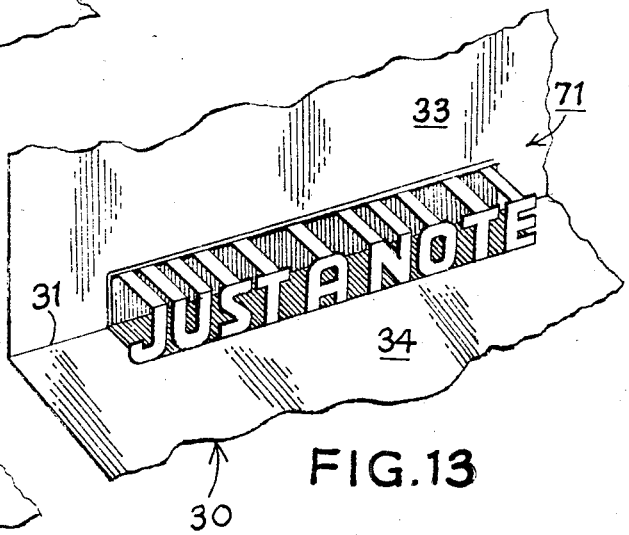
FIG. 13 is fragmentary perspective view showing the insert of FIG. 10 mounted along the interior fold line of a folded stationery sheet.

Peelable backing strip 73 is shown being peeled away at the righthand end of FIG. 10, revealing the underlying adhesive 74 coating the entire double-width base mounting panel 72. Before peeling off the peelable backing strip, however, the assembly of the blank 71 to form the die-cut insert shown in FIG. 13 is preferably accomplished by leaving scored fold lines 67 and 70 substantially flat and unflexed, while infolding rear mounting panel 59 about its fold line 68 by approximately 180 degrees and removing the peelable backing strip 62 from its adhesive coating 61, as shown in FIGS. 11–14. The blank is then flexibly folded about fold line 69, causing the letters 51 and bridge webs 49 to pivot together about fold line 69, bringing adhesive coating 61 into adhering, bonding relationship with the reverse side of distal segment 72A of double-width base mounting panel 72. This operation is most conveniently performed utilizing a table 76 or a similar flat work surface on which the face of peelable backing strip 73 can be placed to support the blank while the foregoing folding operations are performed. By applying force, represented by arrow 77 in FIG. 15, via the bridge webs 49 to the uncoated side of rear mounting panel 59, a strong adhesive bond of coating 61 joining panel 59 to distal segment 72A of base panel 72 assembles the insert 71 into its collapsible parallelogram configuration, as indicated in FIGS. 12 and 16.

It will be understood that the thickness of each of these panels and adhesive coatings is greatly exaggerated in the cross-sectional diagrammatic views of FIGS. 14–17, in order to illustrate the cooperation of these various structural features.

As indicated in FIG. 12, the double-width peelable backing strip 73 is then removed from the wide base mounting panel 72, exposing the adhesive coating 74 thereon. The fold lines 68 and 69 are then brought toward each other by collapsing the parallelogram toward the position shown in FIG. 16, causing fold lines 70 and 67 to be spread further apart, and the partially collapsed parallelogram insert is then lowered into position near the fold line 31 between panels 33 and 34 of stationery sheet 30 toward the seated position shown in FIG. 16, with fold line 70 of the sition shown in FIG. 16, with fold line 70 of the line 31 of stationery sheet 30. In this position, the proximal portion of adhesive coating 74 is bonded to stationery panel 34, anchoring the parallelogram insert 71 in the position shown in FIG. 16, while the distal portion of adhesive coating 74 is exposed, facing upper panel 33 of stationery sheet 30.

Figure 17:
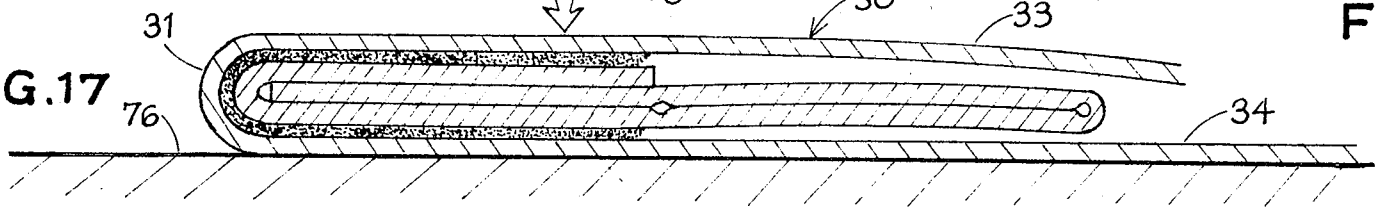

When this upper panel 33 is folded down about its lower edge fold line 31 toward center panel 34, toward the folded position shown in FIG. 17, by applying force indicated by the arrow 78, the distal portion of adhesive coating 74 is thereby brought into adhesive contact with the facing surface of upper stationery panel 33, as shown in FIG. 17, and the parallelogram is flattened between panels 33 and 34 as they are folded together about fold line 30. When the reverse unfolding pivoting movement of panel 33 away from panel 34, pivoting around fold line 30 toward the position shown in FIGS. 1 and 9 has occurred, the flattened parallelogram insert 71 is erected into the position shown in FIG. 13, with its base panel 72 firmly secured by adhesive 74 to both panels 33 and 34 of the stationery sheet 30.

In this fashion, the user may take a flattened insert blank 71, as shown in FIG. 10, assemble it into a parallelogram insert, and mount it at the position desired along fold line 31 of the stationery sheet 30, providing a "do-it-yourself" pop-up message-bearing piece of stationery, presenting the message selected by the user in the precise position chosen by the user. Again, insert blank 71 can be pre-assembled and stored flat, for selection by the user who merely moistens or peels the peelable strips from the adhesive and mounts the insert wherever desired.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

I claim:

1. A folded stationery piece incorporating a three-dimensional message display comprising a foldable stationery sheet having at least one fold line subdividing the sheet into a first panel and a second panel, a first sequential message displaying array of cut-out alphanumeric indicia sheet segments substantially parallel to the first panel having proximal edges foldably joined to the second panel and distal edges spaced from the second panel, a second sequential array of cut-out bridge web sheet segments substantially parallel to the second panel having distal ends foldably joined to the distal edges of the alphanumeric indicia sheet segments and proximal ends foldably joined to the first panel and spaced from the second panel, with the indicia sheet segments and the bridge web sheet segments all being cut from a single sheet panel by removing portions of the panel between adjacent segments, whereby each cut-out alphanumeric indicia sheet segment forms with at least one cut-out bridge web segment and the two sheet panels a collapsible folding structure having a parallelogram cross-section with diagonally opposite apices at said fold line and at a parallel line where said alphanumeric segments and said bridge web segments are foldably joined, said parallelogram cross-section being collapsed flat when the first and second panels are folded together about the fold line, and erected into an upstanding three-dimensional cut-out indicia-display configuration when the panels are hingeingly separated by unfolding the stationery sheet about the fold line.

2. The folded sheet stationery piece defined in claim 1, wherein the indicia cut-out alphanumeric sheet segments are all arrayed in substantially the same plane with their proximal edges aligned along a common fold line on the second panel.

3. The folded sheet defined in claim 1, wherein the cut-out bridge web sheet segments are all arrayed in substantially the same plane with their proximal ends aligned along a common fold line on the first panel.

4. The folded sheet defined in claim 1, wherein the single panel from which the segments are all cut is the stationery sheet itself, and wherein its fold line crosses the removed portions thereof, whereby the distal segment ends foldably joined to the distal edges of the indicia segments can be everted forward in front of the fold line, forming with the foldable sheet a collapsible step configuration.

5. The folded sheet defined in claim 1, wherein the single sheet panel from which the segments are all cut is an independent sheet blank provided with a single base mounting panel foldably joined to the proximal edges of the indicia sheet segments and a single rear mounting panel foldably joined to the proximal ends of the bridge web segments, both mounting panels being provided with adhesive means positioned to join each of them to a respective panel of the stationery sheet, thus arraying the segments along the fold line.

6. A three-dimensional message display insert formed from a stiff foldable sheet blank for mounting along a fold line of a foldable stationery sheet comprising a transversely elongated single planar base mounting panel forming the lower portion of the sheet blank, a transversely elongated single planar rear mounting panel forming the upper portion of the sheet blank, a first sequential array of cut-out alphanumeric indicia sheet segments having proximal lower edges all foldably joined to the single planar base mounting panel, and having upper distal edges, and a second sequential array of cut-out bridge web sheet segments having lower distal ends foldably joined to the upper distal edges of the indicia sheet segments, and having upper proximal ends all foldably joined to the single planar rear mounting panel, with the spaces between the bridge web segments and indicia segments being severed and cut away from the sheet blank making each alphanumeric indicia segment independent from the others, with the width of each array and of each mounting panel perpendicular to the elongated transverse length of the mounting panels being substantially equal, whereby adhesive mounting of the mounting panels of the insert to the stationery sheet with their free edges substantially abutting along the fold line of the stationery sheet provides a collapsible parallelogram-shaped display insert.

7. The sheet blank defined in claims 5 or 6, wherein the bridge web sheet segments are formed in the shape of alphanumeric indicia sheet segments, providing a double row of sequentially arrayed message-display indicia segments.

8. The message-display insert defined in claim 6, further including an adhesive coating positioned on the face of each mounting panel and a peelable backing strip applied to the surface of each adhesive coating.

9. The message-bearing display insert defined in claim 6, further including a glue coating applied to the face of each mounting panel, activatable by re-moistening by the user prior to mounting theinsert along a fold line of a foldable sheet.

10. The message-display insert defined in claim 6, wherein the base mounting panel is dimensioned with its width, perpendicular to its elongated transverse length, being substantially double that of the rear mounting panel, and is provided with a central transverse score line, whereby the rear mounting panel is dimensioned to be adhesively secured to the back of the free edge portion of the base mounting panel, with the foldable joints and the score line providing the apex edge portions of a collapsible and erectable insert having a parallelogram cross-section.

* * * * *